United States Patent [19]

Schultz

[11] 3,948,625

[45] Apr. 6, 1976

[54] IRRADIATION AND ELECTROSTATIC SEPARATOR

[75] Inventor: Mortimer A. Schultz, State College, Pa.

[73] Assignee: Environmental Master Systems, Inc., New Philadelphia, Ohio

[22] Filed: July 24, 1972

[21] Appl. No.: 274,661

[52] U.S. Cl. ..... 55/102; 55/138; 55/146; 55/154

[51] Int. Cl.[2] ..... B03C 3/12

[58] Field of Search ..... 55/102, DIG. 38, 136, 137, 55/139, 146, 138, 150, 154, 143, 145; 250/435, 436, 437, 438, 493; 204/157.1 R, 157.1 H, 162 HE, 158 HE, 53, 54 R, 55, 74 R

[56] References Cited

UNITED STATES PATENTS

| | | | |
|---|---|---|---|
| 1,232,395 | 7/1917 | Schmidt et al. | 55/9 |
| 1,342,651 | 6/1920 | Squires | 55/152 X |
| 1,650,097 | 11/1927 | Schmidt | 55/102 X |
| 2,142,129 | 1/1939 | Hoss et al. | 55/137 |
| 2,275,001 | 3/1942 | Anderson | 55/130 |
| 2,381,455 | 8/1945 | Jacob | 55/102 |
| 2,721,941 | 10/1955 | McMaster et al. | 426/240 X |
| 2,739,283 | 3/1956 | Roehrig | 55/102 X |
| 2,894,846 | 7/1959 | Stoddard | 426/240 |
| 2,939,006 | 5/1960 | Oswald | 250/44 |
| 2,980,202 | 4/1961 | Meyer | 55/154 X |
| 2,992,927 | 7/1961 | Radouco-Thomas | 426/240 X |
| 3,093,489 | 6/1963 | Alexander et al. | 426/240 |
| 3,434,840 | 3/1969 | Huff | 99/217 |
| 3,482,991 | 12/1969 | Schroeder | 426/240 |
| 3,594,275 | 7/1971 | Ransohoff et al. | 250/493 X |
| 3,767,918 | 10/1973 | Graybeal | 250/436 X |

FOREIGN PATENTS OR APPLICATIONS

| | | | |
|---|---|---|---|
| 301,258 | 11/1954 | Switzerland | 55/102 |
| 217,221 | 3/1942 | Switzerland | 55/130 |
| 306,042 | 6/1955 | Switzerland | 55/154 |
| 155,683 | 3/1954 | Australia | 55/146 |
| 834,510 | 8/1938 | France | 55/124 |
| 701,975 | 6/1954 | United Kingdom | 55/103 |
| 887,040 | 6/1943 | France | 55/150 |
| 136,344 | 2/1950 | Austria | 55/127 |
| 161,306 | 2/1955 | Austria | 55/102 |
| 697,918 | 9/1953 | United Kingdom | 55/102 |
| 717,705 | 11/1954 | United Kingdom | 55/102 |
| 842,147 | 7/1960 | United Kingdom | 55/102 |
| 843,782 | 8/1960 | United Kingdom | 55/102 |
| 848,687 | 9/1960 | United Kingdom | 310/10 |
| 299,359 | 8/1954 | Switzerland | 55/135 |

OTHER PUBLICATIONS

German Printed Application No. 1,040,379, KL. 61a 19/20, Inter. KLA 626, Printed 10–2–58, Inv. Ludger Funder (3 sheets dwg. 4 pp spec.).

"Irradiation of Food," Food Manufacture, Oct. 1954, p. 398.

Safe Handling of Radioisotopes in Industrial Radiography, Picker X–Ray Corporation, White Plains, N.Y., 250–493, pp. 8–13, 15, 16, 18, 20, 21, 23–25 and 30.

Schweigert, B. S., Niven, Jr., C. F., Doty, D. M., and Kraybill, H. R., Cold Sterilization of Meat Circular No. 10, Feb. 1954, issued by American Meat Institute Foundation, 939 East 57th St., Chicago, Ill., 10 pages, 426–240.

*Primary Examiner*—Bernard Nozick

*Attorney, Agent, or Firm*—Dominik, Knechtel, Godula & Demeur

[57] ABSTRACT

An apparatus for collecting pollutants in which a passageway is formed to define a path for industrial gases passing therethrough. A plurality of isotope sources extend along at least a portion of the path followed by the industrial gases to provide a continuing irradiation zone for pollutants in the gases. Collecting electrode plates are associated with such an irradiation zone to efficiently collect particulates as a result of an electrostatic field established between such plates, particularly very small particulates. The series of isotope sources are extended for a length sufficient to attain material improvement in the efficiency of collecting the pollutants. Such an effective length is established along a substantially unidirectional path of the gases, or preferrably a reversing path in a folded conduit assembly to attain further efficiency by allowing more compact apparatus structures.

8 Claims, 4 Drawing Figures

IRRADIATION AND ELECTROSTATIC SEPARATOR

This invention relates to an apparatus for collecting pollutants present in moving gases, particularly industrial gases having particulate pollutants which may reach very small sizes. The invention still more particularly relates to an apparatus which utilizes high energy and high intensity isotope sources in combination with an electrostatic field to attain improved efficiences in collecting particulate pollutants.

A method and apparatus has been disclosed by Charles M. Schmidt, Ser. No. 83,874, filed Oct. 26, 1970, now abandoned and assigned to the same assignee, wherein high energy and high intensity isotopes are utilized for charging particulate pollutants along and in association with an electrostatic field.

Such copending application may be referred to for further understanding steps and elements associated with the use of high energy and high intensity isotope sources, including various means for positioning a variety of isotope sources in the path of the industrial gases prior to collecting the pollutants in various ways. It is desirable to adopt the means disclosed in such copending application and to utilize them in a particularly improved manner in a novel apparatus for increasing the efficiency of pollutant collection, especially particulate pollutants which may be of very small size.

The terms "industrial" or "effluent" may be used together or separately, but such terms are intended to refer to gases generated by various chemical processes, wherein particulates are present in large, undesirable amounts. The terms are also intended to include gases generated by combustion of carbonaceous fuel, wherein both particulate and gaseous pollutants occur. The gaseous pollutants most annoying and hazardous and sulfur dioxide, nitric oxide, or the like. The term "effluent" gases may also refer to gases in which are present particulates arising from handling materials such as cement, asbestos, fiber glass and the like. Conventional electrostatic precipitators, also known as Cottrell precipitators, have shortcomings, particularly in limited efficiency in collecting pollutants containing very small sized particulates. Another disadvantage is the cost involved in high power demands for actuating a corona discharge and a corona wire for negatively charging particulates in the effluent gas. In the copending application previously referred to, advantages were set out in relation to using an electrostatic field in combination with a high energy and high dosage radiation field.

The gamma rays and particles from the high energy and high intensity isotope source, charge the particulates by a diffusion type of procedure. In one aspect, electrons are released the the action of the radiations striking housing materials in the irradiation zone, such electrons being accelerated by the electrostatic field to thereby increase the impact with the pollutant particules, thereby imparting a negative charge to such particulates. In another aspect, the radioactive materials strike the particulate pollutants directly to knock off electrons, thereby leaving positively charged ions and particles. The knocked-off electrons are further accelerated by the electrostatic field with subsequent impact with particulates and formation of negatively charged particles. The positive and negative electrodes or plates of a collection assembly thereby collect both negatively and positively charged particles, respectively, to increase the efficiency of collection of pollutant particulates.

The foregoing copending application provides a method and apparatus wherein effluent gases are delivered into a passageway placed in the path of such gases. Intermediate the ends of the passageway is an irradiation zone wherein high energy and high dosage producing levels of radiation emitting isotopes are located. The passageway is surrounded with shielding materials such as high density concrete to sustain the radiations within the passageway. The irradiated pollutants move with the flue gas from a passageway outlet to be collected by standard collection practices, with or without the cooperation of an electrostatic field. It is desirable to incorporate the advantages of such a teaching in an improved apparatus to attain materially higher efficiencies in collection of pollutants, particularly particulates.

It is accordingly one important object of the present invention to provide improved apparatus for collecting pollutants from industrial gases wherein a radiation zone is provided in combination with an electrostatic field so that an effective radiation field continues for extended lengths of the path of the moving industrial gases to materially increase the efficiency of collection.

Still yet another important object of the present invention is an improved apparatus wherein an elongated irradiation zone is provided as a series of separated isotope sources in the path of the industrial gases, and wherein electrode collecting plates adjoin the path so the electrostatic field created between them thereby may advantageously combine with the series of spaced isotope sources to attain greater efficiences in collection.

Another object of the present invention is an improved apparatus wherein a high energy and high intensity series of isotopic sources are disposed in an elongated series along a substantial portion of a path followed by industrial effluent gases, and wherein such passageway continues for a substantial portion to attain an effective length wherein particulates charged by radiations are collected by using an electrostatic field. This object is also attained by using an electrostatic field. This object is also attained by providing a reversing path for the effluent gases with the charged particulates, such path being defined by a folded conduit to efficiently attain collection of the charged particules without unduly extending the passageway and incurring concomitant problems of shielding, construction and the like.

Still yet another important object of the present invention is to provide an improved apparatus of the type described wherein serially disposed containers of high energy and high intensity isotopic sources effectively charge pollutant particulates over a substantial length of a path followed by effluent gases, and providing a collecting plate area which increases in area as the radiation field decreases to attain even greater efficiencies in the collection of particulates.

Objects such as the foregoing are now attained by the invention to be shown in the following disclosures, which includes drawings wherein.

Use of the same numerals in the various views of the drawings will indicate a reference to like parts, structures, or elements, as the case may be.

Figure 1:
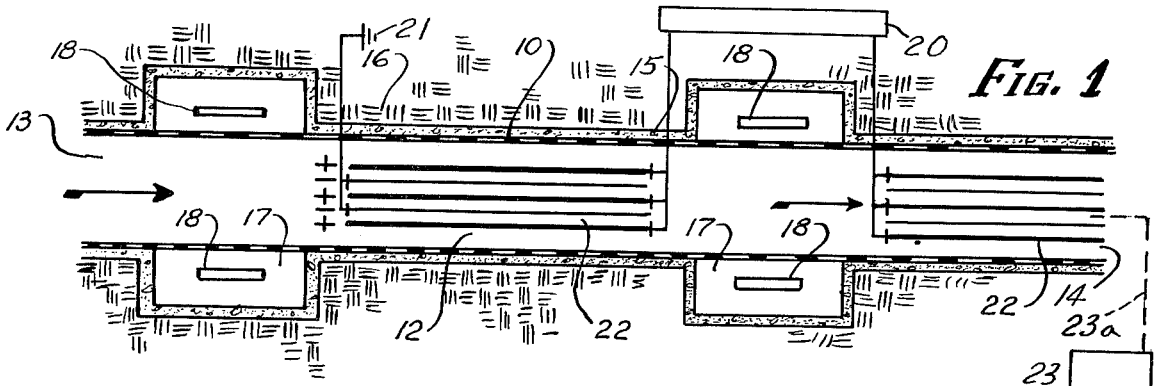
FIG. 1 is a highly schematic representation illustrating one form of the invention for collecting particulates from effluent gases in an improved manner.

The improved apparatus of this invention utilizes high energy emitting isotopes of the type described in the foregoing copending application. They are generally gamma ray emitters although it is possible to use isotopes or combinations of isotopes which also emit alpha and beta particles. The invention provides that an elongated isotope source is provided, either continuous or as a plurality of spaced isotope sources. The elongated isotope source is provided along a substantial portion of the path followed by the effluent gases. It is also provided that each isotope source, continuous or spaced, be provided at energy levels in excess of 200,000 electron volts, and prefereably at least one million electron volts.

It is further required that the isotope source be provided at dosages of at least one Rad, preferably at least 200 Rads. Such high energy and substantial dosage serves the advantages of the invention, although it is preferred to employ higher levels to attain still greater advantages. In particular, energy levels in excess of 500,000 electron volts are preferred, and levels of at least one million electron volts are viewed as desirable. Likewise, high dosages are preferred in excess of 200 Rads, and even one kilorad, or greater dosages may be desirable.

While minimum energy and dosage levels are provided, it will be appreciated that a continuous elongated source by preferably provided at the same dosage level as a plurality of equivalent spaced isotope sources.

There is no particular or critical length required for the elongated isotope source, since advantages accrue by extending such lengths over a substantial portion of the effective passageway measured from the beginning of the elongated isotope source to the passageway outlet. The term "substantial" is intended to mean at least, say, about one-tenth of the effective passageway, up to a length which is substantially coextensive with the effective passageway when considering spaced isotope sources.

A continuous elongated isotope source may comprise an elongated tube filled with separated isotope sources in closely adjoining or abutting relationship, or may represent an elongated rod. In the preferred embodiment, however, a plurality of spaced isotope sources are provided.

The particular advantages arise from a combination of the elongated isotope source and the length and size of an electrostatic collection area. In the preferred form, the collection area is at least a major portion of the effective passageway. The elongated isotope source, spaced or continuous, comprises the irradiation zone. The electrostatic field and collecting area may be coextensive with the irradiation zone, may be in advance theereof, or both.

The electrostatic field is conventionally set up by establishing positive and negative plates or electrodes with potential difference therebetween. The electric field may be expressed in terms of volts per cm between the plates. No large amount of current is required, only a potential difference need be established to attract the previously charged particles. The electrostatic field itself plays only a small part in forming the charged particles, which are essentially a result of the action of the high dosage irradiation. Spacing plates closer together results in a greater electrostatic field for a given potential difference. A marked advantage of providing an electrostatic field in combination with an irradiation field is that greater collection efficiency is attained for the collection of small sub-micron sized particles.

Referring now to the drawings, FIG. 1 illustrates a conduit contained within sidewall 10 defining a passageway 12. Effluent or industrial gases enter the passageway by way of inlet 13 and follow a path eventually leading to outlet 14. Shielding for the passageway includes a concrete skin 15 surrounded by earth or lead fill designated at 16. The concrete skin, or the like, is illustrated as being modified to form a plurality of irradiation chambers 17 which collectively comprise an irradiation zone. Each chamber is shown as containing a high energy and high intensity isotope source on each side of a coaxial point in the passageway, so that the irradiations are directed toward the central portion of the passageway.

Between the spaced isotope sources 18 is a group of collecting one of which is designated at 22. Alternating plates in the group may be connected to a high voltage source, 20 and the other pairs of alternating plates may be grounded at 21 to set up the electrostatic fiels, as shown. Such collecting plates may continuously extend past the radiation chambers, rather than being placed between such chambers as shown. Here, the collecting plates or electrostatic field is shown substantially coextensive with the effective passageway from the beginning of the irradiation zone to the passageway outlet. Particulates collected on the plates may be discharged into collecting means 23 along line 23*a* by conventional steps.

It will also be appreciated that the number of irradiation chambers may be increased along a substantial portion of the path followed by the industrial effluent gases through the conduit. Such an extension will, of course, provide an even greater density of irradiation to more effectively charge the particulate pollutants in the effluent gas. It will be appreciated that various conventional means may be provided for rapping the collecting plates to dislodge the collected particulates, as well as providing means for collecting such particulates. None of such means are indicated because they may be conventionally provided.

Figure 2:
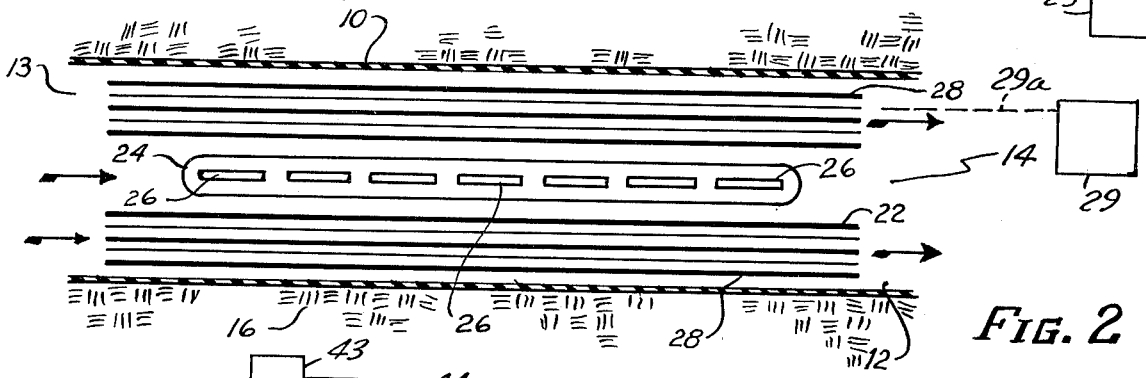
FIG. 2 is another highly schematic representation showing another form of an apparatus useful for the same purposes.

Another form of the apparatus is indicated in the view of FIG. 2 wherein effluent gases enter the apparatus through inlet 13 into passageway 12, and eventually move out of outlet 14. The irradiation zone comprises a single irradiation chamber having an elongated housing 24 in which a plurality of isotope sources are in containers indicated at 26, such containers being aligned substantially at the central portion of the passageway 12. The housing 24 and containers 26 therein may be variously mounted or supported by conventional means, none of which are shown; and such means are not viewed as essential to an understanding of the invention.

The elongated housing 24 is made of electrically conductive material so that a high voltage source may be connected thereto and to the alternating plates beginning with a plate once removed from the elongated housing. The alternating plates, beginning with the plates immediately adjoining the adjacent housing, may then be grounded to set up the electrostatic field between the interlaced plates in the usual way. In this embodiment, the passageway is intended to by cylindrical, and the various collecting plates are also intended to represent concentric cylinders. The schematic illustration of FIG. 2 depicts closer spacing of collecting plates or electrodes towards the continuous conduit wall 10. It is generally preferred, in such embodiments that the collecting plates are spaced closer together the farther they are from the irradiation zone. Such outwardly positioned concentric collecting plates will understandably have greater areas as well as closer spacing, and this combination will serve to increase the strength of the electrostatic field between such more closely spaced electrodes of greater area for a given potential difference therebetween. In this way, the electrostatic field and collection area increase as the radiation field decreases to attain greater efficiency. By way of illustration, spacing of electrode 28 relative to conduit wall 10 is closer than spacing of electrode 22 to elongated housing 24. The particulates collected on the electrodes may likewise be discharged into collecting means 29 along line 29a by conventional steps.

Figure 3:
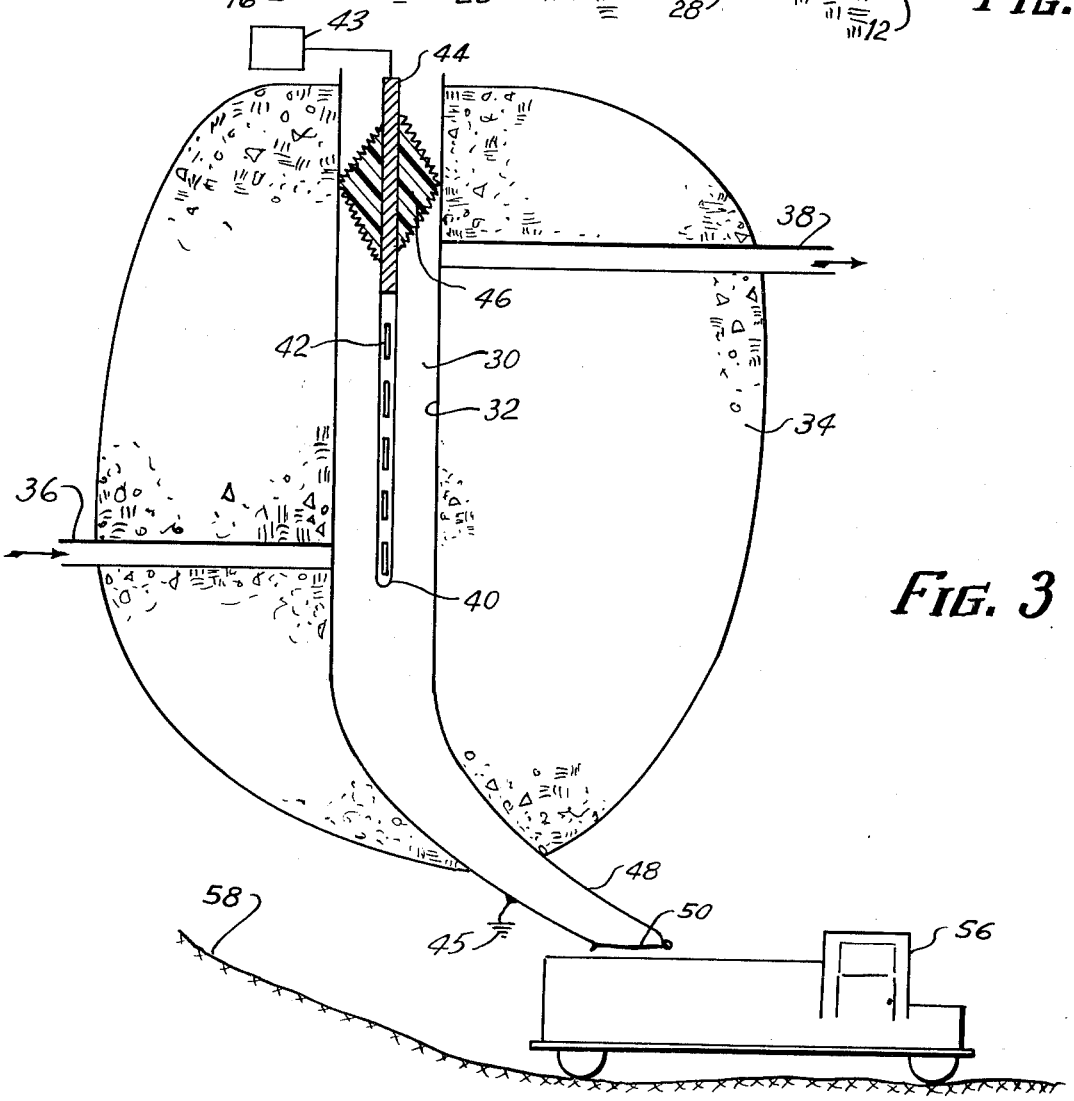
FIG. 3 is yet another highly schematic representation of still another form of the apparatus for attaining the purposes previously described.

Another form of the apparatus is shown in the view of FIG. 3 wherein passageway 30 is shown as being substantially vertical. An electrically conductive continuous conduit wall 32 defines the passageway 30, and such conduit is shown surrounded by a body of shielding 34 which may be lead fill, earth fill, or the like. An inlet branch 36 and and outlet branch 38 are disposed normally to the long axis of the passageway and communicate therewith.

The irradiation zone is shown as including an elongated housing 40 defining an irradiation chamber and containing a plurality of containers 42 for the spaced isotope sources. This is similar to the irradiation chambers shown in the view of FIG. 2, except the lower end of the housing 40 is closed by a portion of the housing material, and the upper end is closed by an elongated conductive shielding plug 44. The plug is preferably lead to block radiations as well as being electrically conductive. A high voltage source 43 is connected to the lead plug, as indicated, and an insulating body 46 is placed between the plug and the conduit wall 32 to insulate the high voltage plug and elongated housing 40 from conduit wall 32 which is grounded as shown.

Conduit wall 32 is grounded at 45 and is sloped at a lower portion which terminates in sloping extension 48 having an opening or discharge fitted with a hopper door 50, operable to close and open the discharge. The collected particulates are removed from the apparatus through the open hopper door 50 into collecting means or a collector such as dump truck 56. The dump truck moves along passage 58 which may be a subterranean road or passage when the apparatus is erected at ground or below ground level. The apparatus may, of course, be supported at an elevation above ground level by a framework which is not shown. In such a case, the collector 56 will move along a ground level passage. In the embodiment illustrated in FIG. 3, the electrostatic field is indicated as established between the elongated housing 40 and the conduit housing wall 32. It should be understood, however, that a group of interlaced collecting plates can be provided with features as described in relation to foregoing FIGS. 1 and 2.

Figure 4:
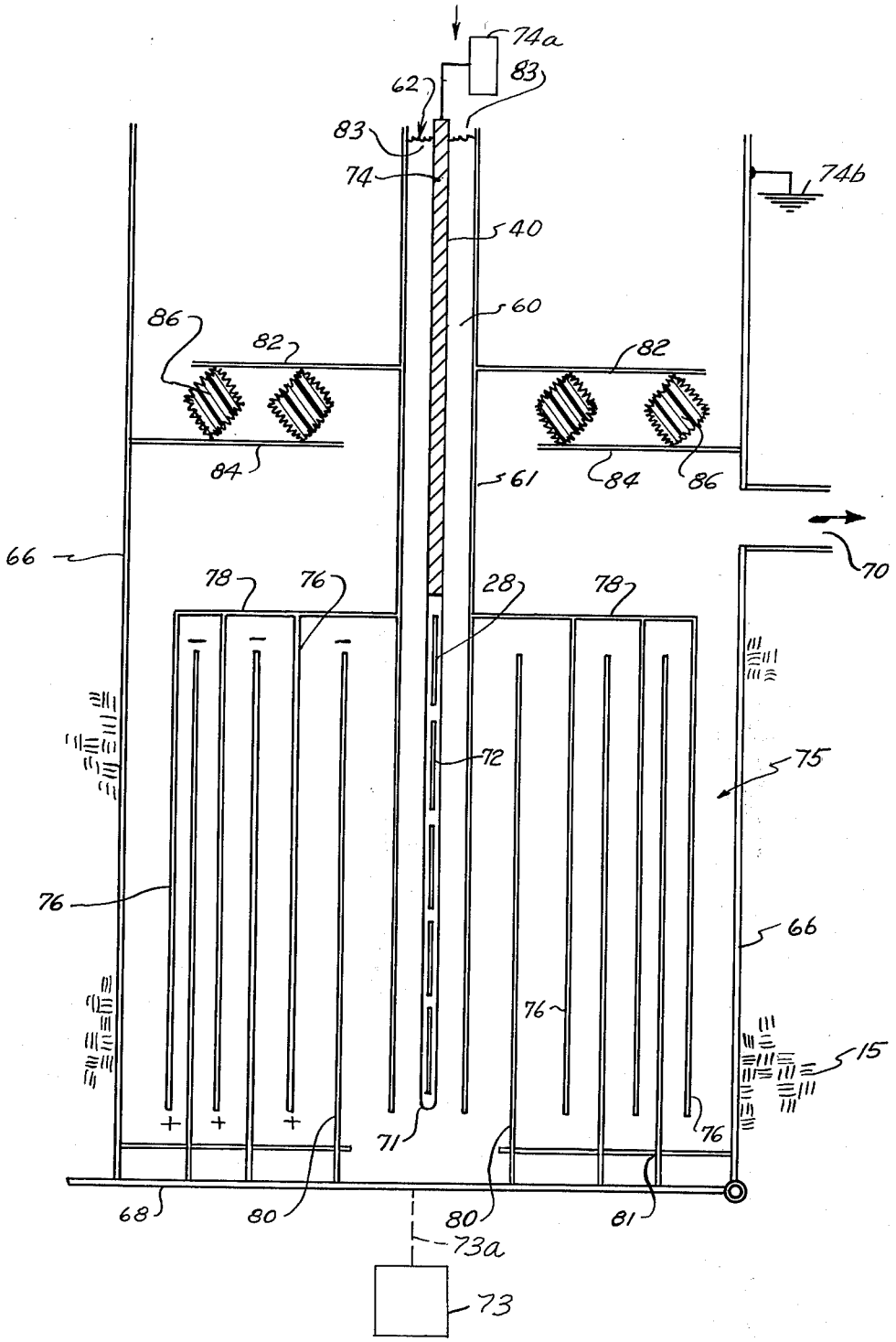
FIG. 4 is yet another highly schematic form of still another alternative form of an apparatus for attaining the purposes described.

The embodiment of FIG. 4 utilizes the advantage of an effective length of an irradiation zone and a collecting zone in an electrostatic field. The charged particles passing through the irradiation zone along a substantial portion of the passageway are then efficiently collected in an elongated conduit passage having an electrostatic field which grows greater in strength as a point becomes farther removed from the irradiation zone. A substantially unidirectional passageway 60 is defined by straight continuous conduit walls 61. Such a straight passage is disposed substantially vertically, and the top has an inlet 62 for the effluent or industrial gases. A botton wall 68 of the apparatus is provided with means (not shown) for discharging collected particulates to a collector 73 along line **73*a*. The outlet 70 is formed in one of the sidewalls 66** of the apparatus.

An elongated housing 71 for the spaced isotope source containers 72 has an elongated conductive plug 74 mounted to one of its ends, in a manner similar to that shown in the view of FIG. 3. The high voltage source **74*a* is connected to the plug, and one of the walls is grounded as indicated at 74*b*.**

After leaving the unidirectional passageway in straight conduit 61, the effluent gases follow a reversing path in folded conduit assembly shown generally as 75. The folded conduit includes a first set of alternating plates or coaxial cylinders 76 which depend from upper wall 78. The first set of collecting plates or electrodes are interlaced with a second set of alternating plates 80 which contact base wall 68, and which are mounted to sidewalls 66 by ties 81 to support such plates. The industrial gases follow a reversing path from the bottom of conduit passageway 60 and through the folded conduit path formed by the alternating plates 76, 80, such path in part confined by top wall 78 and bottom wall 68. The downwardly depending plates 76 are connected to the high voltage source by a conductor 83 which connects conduit wall 61 and elongated plug 74. The other set of plates are grounded by connection through sidewall 66.

The straight conduit portion and first set of plates are mounted in spaced relationship to the second set of plates by upper support arms 82 and lower support arms 84 having a plurality of insulator bodies 86 therebetween which may additionally serve to support such arms in spaced relationship. The arms may be otherwise mounted to portions of the apparatus not shown to provide added or sole support. Such insulated bodies or masses electrically insulate the high voltage portion from the grounded portions of the straight and folded conduits.

The first and second set of collector plates may be cylindrical so they are concentrically disposed relative to the radiation chamber. The farther such plates are concentrically displaced from the radiation chamber, the closer they are spaced together to increase the electrostatic field through the greater area and closer spacing of the plates.

According to the invention disclosed herein, the radiation field, or irradiation zone, may be substantially coextensive with the total collection length of the path of effluent gases in the passageway. Such an embodiment is illustrated in the foregoing view of FIG. 2. The irradiation zone may be also extend for a substantial portion of such collection lengths defined by the path of the gases between the inlet and outlet, this embodiment being shown in the views of FIGS. 3 and 4. In any event, extended length is provided for both radiation and electrostatic fields to markedly increase the efficiency of the collection. Extending the length of the irradiation zone tends to assure desired levels of charging particulate pollutants so that it only remains for an effective length of an electrostatic field and collecting area to collect the charged particulates. Desired lengths of, say, 15–20 feet can be provided, or such lengths can be substantially shortened by adopting the folded conduit embodiment of FIG. 4. Such effective lengths should desirably extend from the irradiation zone to the passageway outlet, which is assumed to be proximate to the terminating portion of the electrostatic field.

The claims of the invention are now presented in terms which may be additionally understood by reference to the disclosure of the foregoing drawings and the language of the foregoing description.

What is claimed is:

1. An apparatus for removing pollutants from industrial gases, including a conduit defining a passageway having an inlet and an outlet, means to convey the industrial gases into said passageway inlet, an elongated irradiation conduit portion zone intermediate said inlet and outlet within said passageway, said zone comprising a plurality of serially disposed isotope sources in said conduit portion, an effective passageway portion measured from the beginning of the elongated irradiation zone to the outlet, each of said isotope sources creating a radiation field at energy levels in excess of at least 1,000,000 electron volts, and providing a substantial dosage level in excess of 200 Rads, so that pollutants are effectively charged in passage through the irradiation zone, electrodes of alternating polarity adjacent and downstream of said elongated irradiation zone, said electrodes extending for a length which is substantially coextensive with the conduit portion, said electrodes, and a connected voltage source, establishing an electrostatic field to attract particles oppositely charged in said irradiation zone, and means to remove pollutants attracted to said electrodes, whereby the isotope sources along the substantial portion of the path and the effective length of the electrodes attain high efficiencies of collection.

2. An apparatus which includes the features of claim 1 above wherein said electrodes are a plurality of interlaced collecting plates of alternating polarity, said collecting plates substantially following the path of movement of industrial gases between the elongated irradiation zone and the outlet.

3. An apparatus which includes the features of claim 2 above wherein said passageway includes a reversing path for the industrial gases, said reversing path formed by a folded conduit wherein a first set of alternating collecting plates have their ends bottomed against a wall, and a second set of alternating collecting plates have their ends bottomed against an opposite wall so that the industrial gases follow a reversing path, one of such sets of collecting plates being joined to a high voltage source, and the other set of collecting plates being grounded to set up an electrostatic field between the plurality of interlaced collecting plates defining said folded conduit.

4. An apparatus which includes the features of claim 3 above wherein said first and second set of collecting plates are coaxial cylinders. plates,

5. An apparatus which includes the features of claim 3 above wherein said spaced isotope sources are in a plurality of containers, and said containers are aligned in an elongated electrically conductive housing, an elongated electrically conductive plug mounted to one end of said elongated housing, a high voltage source joined to said elongated plug, and a conductor connecting said elongated plug to one of said sets of collecting plates and means to ground the other of said sets of collecting plates.

6. An apparatus which includes the features of claim 5 above wherein the collecting plates are spaced closer to each other and further such plates are spaced from the isotope sources so that the electrostatic field increases as the radiation field decreases.

7. An apparatus which includes the features of claim 6 above wherein an insulator body electrically insulates high voltage collecting plates from grounded collecting plates.

8. An apparatus which includes the features of claim 7 above wherein a terminating plate of the grounded set has an outlet for the path of industrial gases, one of said opposite walls being a base wall and one of said sets of collecting plates extending upwardly from said base wall toward the other of said opposite walls from which the other set of collecting plates depend downwardly, and collecting means for receiving charged particulates attracted to said collecting plates.

* * * * *